US007507106B2

(12) United States Patent
Keswani et al.

(10) Patent No.: US 7,507,106 B2
(45) Date of Patent: Mar. 24, 2009

(54) PUSH-IN WIRE CONNECTOR WITH IMPROVED BUSBAR

(75) Inventors: Sushil N. Keswani, Sycamore, IL (US); Benjamin D. Swedberg, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 11/763,096

(22) Filed: Jun. 14, 2007

(65) Prior Publication Data

US 2008/0311802 A1 Dec. 18, 2008

(51) Int. Cl.
*H01R 4/24* (2006.01)

(52) U.S. Cl. ..... 439/439; 439/723

(58) Field of Classification Search ..... 439/439, 439/441, 721, 723

See application file for complete search history.

(56) References Cited

U.S. PATENT DOCUMENTS 5,975,940 A * 11/1999 Hartmann et al. ..... 439/441
6,039,597 A * 3/2000 Getselis et al. ..... 439/441
6,132,238 A * 10/2000 Hartmann et al. ..... 439/439
6,905,360 B2 * 6/2005 Berger et al. ..... 439/441
7,255,592 B1 * 8/2007 Tseng ..... 439/439
7,287,999 B2 * 10/2007 Holterhoff et al. ..... 439/441
2001/0010981 A1 * 8/2001 Cutler et al. ..... 439/441
2002/0187670 A1 * 12/2002 Cisey ..... 439/441
2007/0072481 A1 * 3/2007 Edenharter ..... 439/441

* cited by examiner

*Primary Examiner*—James Harvey
(74) *Attorney, Agent, or Firm*—Cook Alex Ltd.

(57) ABSTRACT

A push-in wire connector has an improved busbar suitable for use with either solid or stranded wire. The connector has a housing with a hollow interior. At least two openings in the housing provide access to the interior for the ends of wires inserted into the connector. A busbar is mounted in the housing. The busbar defines at least two wire-crossing axes extending from an entry edge to an exit edge and a thickness between a top face and a bottom face. The busbar has a wire-receiving pocket extending below the top face on each of the wire-crossing axes and a wire-engaging protrusion extending above the top face on each of the wire-crossing axes.

12 Claims, 3 Drawing Sheets

Fig. 4
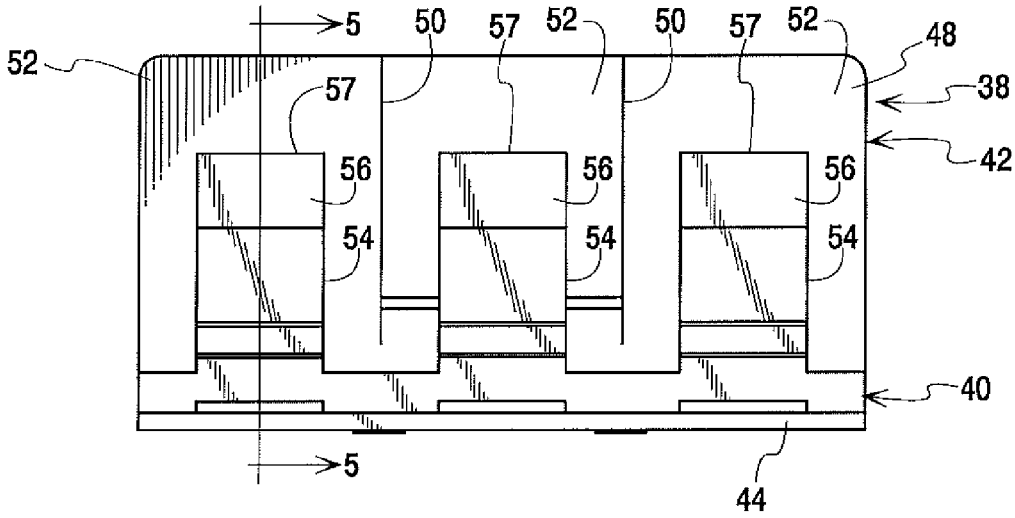
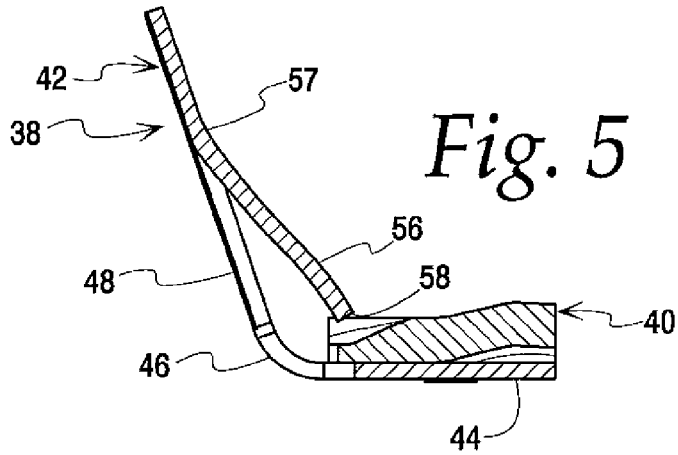
Fig. 5
Fig. 7
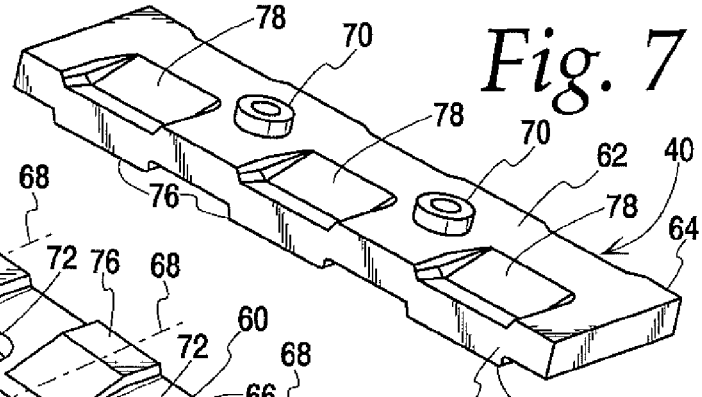
Fig. 6
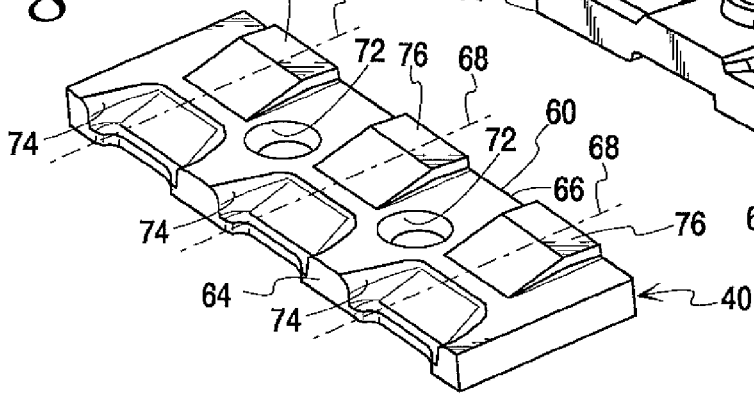

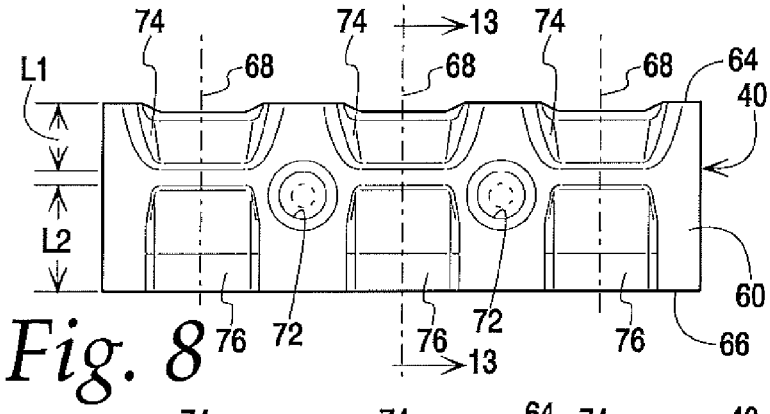
Fig. 8
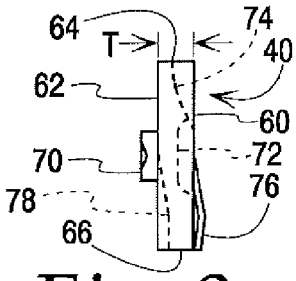
Fig. 9
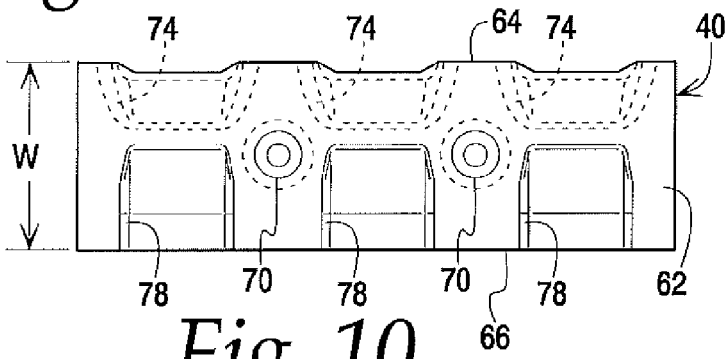
Fig. 10
Fig. 12
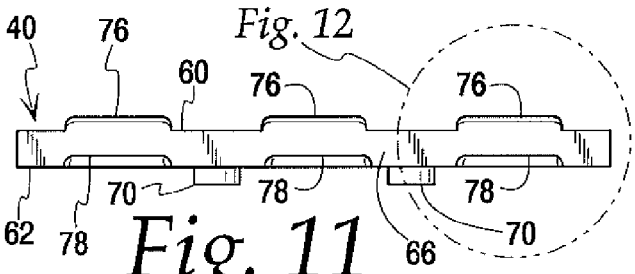
Fig. 11
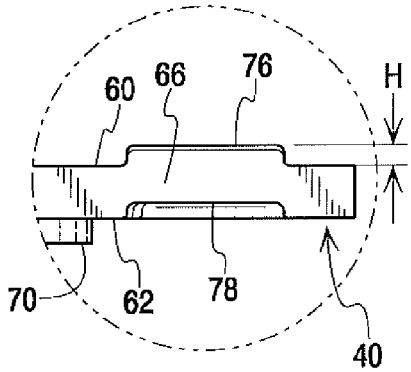
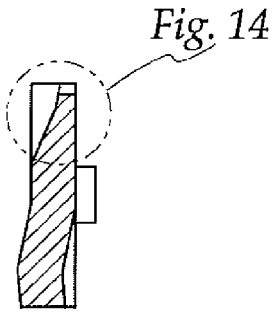
Fig. 13
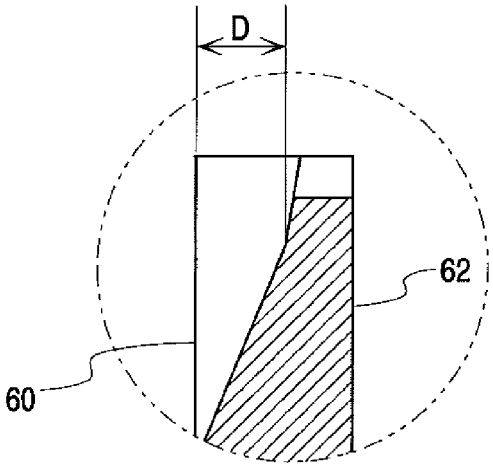
Fig. 14

PUSH-IN WIRE CONNECTOR WITH IMPROVED BUSBAR

BACKGROUND OF THE INVENTION

This invention relates to push-in wire connectors. Push-in connectors operate, as the name implies, by simply pushing a stripped end of two or more wires or conductors into the connector. Once the wires are pushed into the connector no closing, crimping, twisting, insulation displacement or other manipulation of the connector is required to finish the connection, making the push-in connector advantageous from the standpoint of time needed to install it. The push-in connector must perform several tasks including electrically isolating its conductors from the surrounding environment, retaining the conductors in the connector, and providing good electrical conductivity between the conductors.

The electrical isolation function is typically performed by a housing made of electrically insulating material. The housing has a generally hollow interior. Openings in the housing provide access to the interior for the stripped ends of two or more electrical conductors. Once inside the housing the bared ends of the conductors are fully surrounded by the insulating housing.

The function of providing electrical conductivity is performed by an electrically-conductive shorting member. The shorting member, often called a busbar, is inside the housing and is disposed so as to be engageable with all conductors inserted into the housing. The shorting member provides a conductive path between all inserted conductors. Since the primary job of the busbar is conduction, it is typically made of a highly conductive material such as copper or tin-plated copper. But even a highly conductive busbar will not provide good conductivity between conductors if those conductors are not held firmly in contact with the busbar. Thus it is common to include a spring member which works in concert with the busbar to hold the conductors firmly against the busbar. Various arrangements of the spring member are possible, including building it into the housing, building it into the busbar, or making it a separate component in the interior of the housing. In any case, the spring member urges all conductors into solid mechanical and electrical engagement with the shorting member.

The function of holding the conductors in the housing is performed by a retention member that engages the ends of the inserted conductors and prevents axial retraction from the housing. As in the case of the spring member, the retention member could be built into the housing. Alternately, the retention member and spring member can be configured as a combined unit inside the housing. In either case the retention member grasps the conductors and prevents unintentional removal of the conductors from the housing. In some embodiments the retention member is releasable so that conductors may be selectively removed from the housing without damage to any of the components. In other embodiments where it is desired that the conductors not be removed from the connector under any circumstances the retention member is intentionally made to be non-releasable.

As just mentioned, the retention member is often configured in combination with the spring member to apply a force that urges the inserted conductor into contact with the shorting member and prevents retraction of the conductor. A common configuration is to have a resilient metal retention member having spring fingers formed therein. As a conductor is inserted into the housing it engages a spring finger and causes it to flex away from its rest position. The resulting deflection of the spring finger generates a compressive force on the conductor that presses it into solid contact with the busbar. The spring fingered is angled to permit insertion of the conductor past the finger in one direction but withdrawal of the conductor in the opposite direction is not permitted due to the self-locking configuration of the spring finger. Thus, engagement of the spring finger with the conductor provides the dual functions of pressing the conductor into the busbar and preventing withdrawal of the conductor from the housing.

The pressing of the conductor into the busbar, of course, requires a stable structure for resisting the compressive force of the spring finger. While firm support for the busbar can be provided either by the spring member or the housing, or both, a problem can arise when the connector is used with stranded wire. Stranded wire tends to flatten out or splay when subjected to the compressive force of the spring finger. Since the compressive and resistive forces of the spring finger are only created upon deflection of the spring finger, the splaying of the stranded wire reduces or even eliminates this deflection which can then defeat the dual purpose of the spring finger. The present invention addresses this problem.

SUMMARY OF THE INVENTION

The present invention concerns a push-in wire connector having an improved busbar which assists in retaining conductors, including stranded wire, firmly in contact with the busbar.

A primary object of the invention is a push-in connector busbar having a surface which restrains conductors positioned thereon.

Another object of the invention is a push-in connector busbar having a wire-receiving pocket formed on its wire-engaging surface.

Another object of the invention is a push-in connector busbar having a wire-engaging protrusion formed on its wire-engaging surface.

A further object of the invention is a push-in connector busbar having both a wire-engaging protrusion and a wire-receiving pocket formed on its wire-engaging surface.

Still another object of the invention is a push-in connector busbar adapted for support on a spring member and having a wire-receiving pocket opposite a spring finger of the spring member.

Yet another object of the invention is a push-in connector having a busbar of the type described which enables the connector to be used on both solid and stranded wire.

A still further object of the invention is a push-in connector having a busbar with a wire-engaging protrusion formed by coining the busbar.

An additional object of the invention is a push-in connector busbar having a wire-receiving pocket on its entry side and a wire-engaging protrusion on its exit side.

These and other desired benefits of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

These and other objects are realized by a push-in wire connector having a housing and a busbar in the housing. The busbar has a top surface with at least two wire-crossing axes. Each wire-crossing axis intersects at least one of a wire-receiving pocket or a wire-engaging protrusion. In one embodiment, the wire-crossing axis has both the pocket and the protrusion, which together provide a serpentine wire path that enhances the holding power of a spring member.

BRIEF DESCRIPTION OF THE DRAWINGS

FIG. 4 is a front elevation view of the spring assembly.

FIG. 5 is a section taken along line 5-5 of FIG. 4.

FIG. 6 is a perspective view of the busbar, showing primarily the top face thereof.

FIG. 7 is a perspective view of the busbar, showing primarily the bottom face thereof.

FIG. 8 is a top plan view of the busbar.

FIG. 9 is an end elevation view of the busbar.

FIG. 10 is a bottom plan view of the busbar.

FIG. 11 is a front elevation view of the busbar.

FIG. 12 is an enlarged detail view of the portion circled in FIG. 11.

FIG. 13 is a section taken along line 13-13 of FIG. 8.

FIG. 14 is an enlarged detail view of the portion circled in FIG. 13.

DETAILED DESCRIPTION OF THE INVENTION

Figure 1:
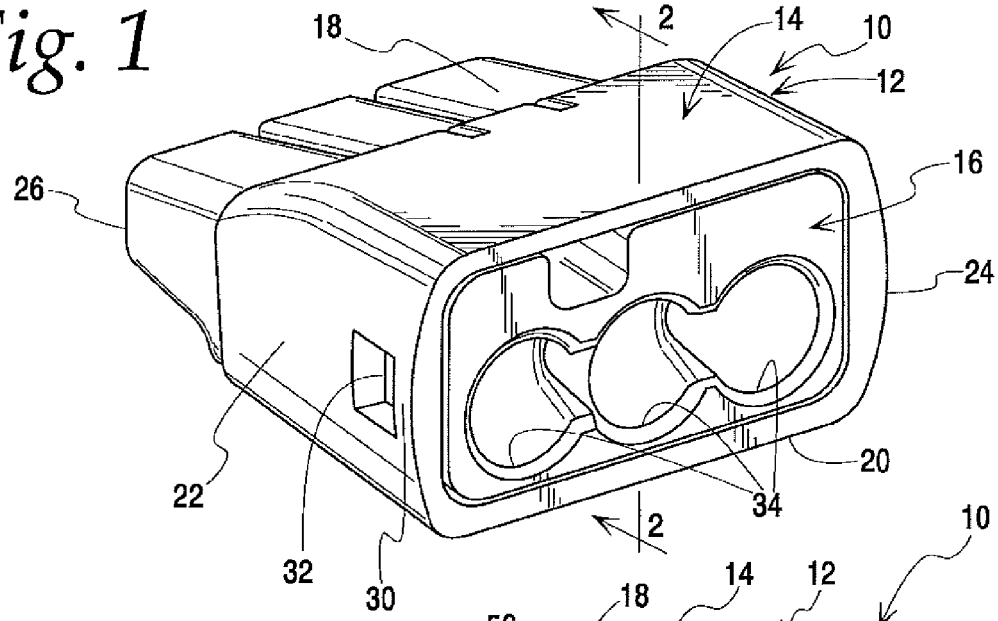
FIG. 1 is a perspective view of the push-in connector of the present invention.
Figure 2:
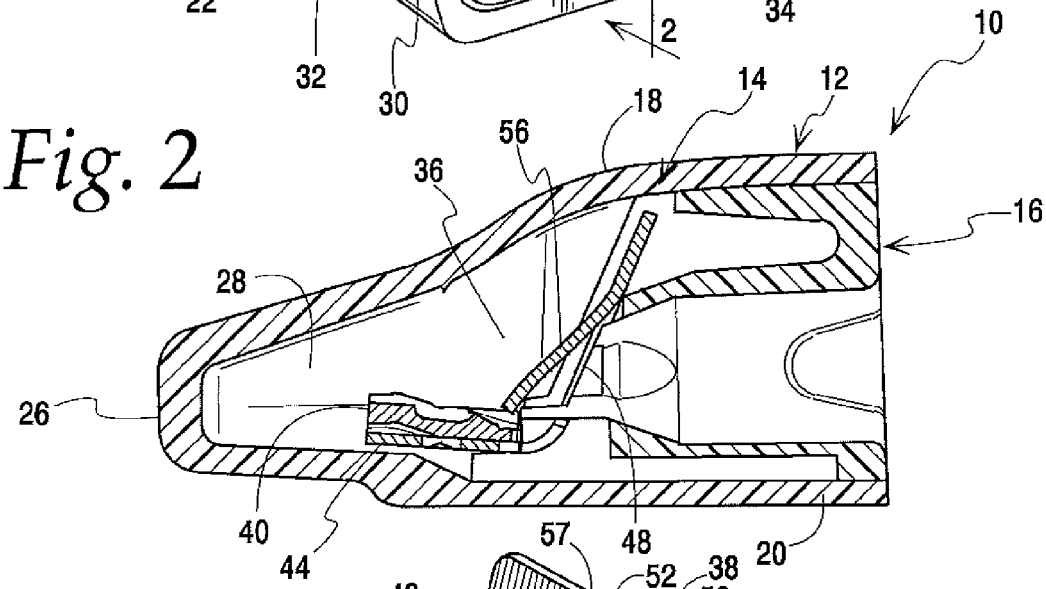
FIG. 2 is a section taken along line 2-2 of FIG. 1.
Figure 3:
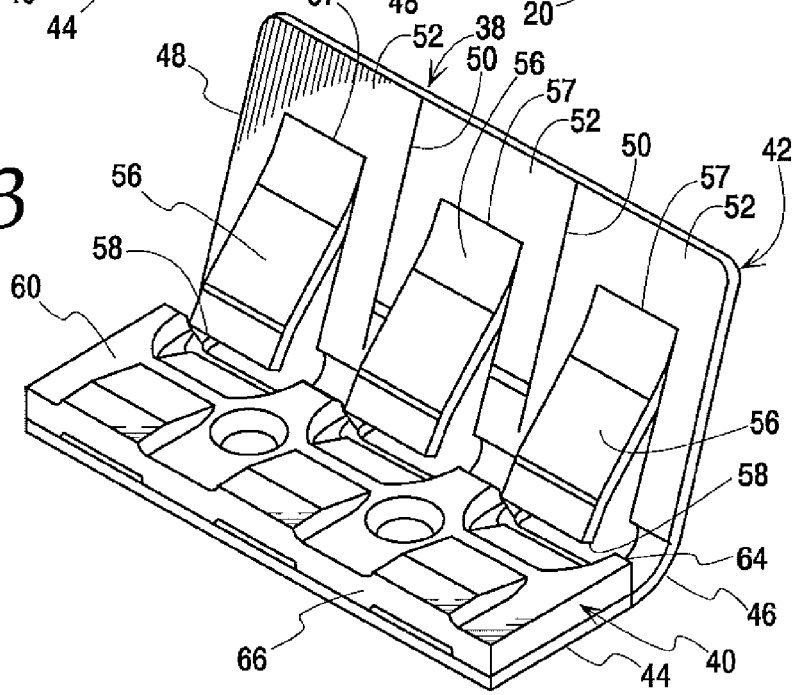
FIG. 3 is a perspective view of the spring assembly comprising a spring member and busbar.

FIG. 1 illustrates the push-in connector 10 of the present invention. The push-in connector has a housing shown generally at 12. In this embodiment the housing is formed in two pieces and includes a five-sided case 14 and a cap 16. The case has top and bottom walls 18 and 20 joined by left and right side walls 22 and 24. A rear wall 26 closes the back end of the case. Together the case walls define a generally hollow interior 28 of the housing. The front side of the case is open to receive the cap 16. The side walls 22, 24 each have a latch 30, one of which can be seen in FIG. 1. The latches 30 engage hooks 32 which protrude from the sides of the cap to retain the cap 16 in the case 14. As seen in FIGS. 1 and 2, the cap has a plurality of ports 34 therethrough. These ports provide access to the hollow interior 28 of the case. Partitions as at 36 may be provided in the interior of the housing to guide the stripped ends of wires as they are inserted into the housing, Turning to FIGS. 3-5 the spring assembly 38 is shown. The spring assembly comprises a busbar 40 supported on a spring member 42. The spring member includes a foot 44 joined at a fold line 46 to an upstanding leg 48. The foot has a pair of apertures (not shown) for receiving rivets of the busbar as will be described below. The leg 48 is a sheet divided by slits 50 into three sections 52. The slits 50 extend from the top edge of the leg and end somewhat short of the fold line 46. Each section 52 further includes a U-shaped slit 54 which defines a spring finger 56. The spring finger is integrally connected to its section 52 at one end 57 and has a free end 58 at its opposite end. As seen in FIGS. 3 and 5 the spring fingers 56 are bent out of the plane of the leg 46. The free end 58 may be further angled somewhat relative to the remainder of the finger to provide an optimum angle for gripping a wire inserted under the spring finger. The spring member 42 is preferably formed of a resilient metal such as stainless steel.

Returning briefly to FIG. 2, it can be seen that the bottom wall 20 of the case 14 cooperates with a lower portion of the cap to support the foot 44 of the spring member 42. Similarly, interior portions of the cap engage the leg 48. These cap portions cooperate with the partitions 36 in the case 14 to restrain the spring assembly 38 in the housing 12. One of the spring fingers 56 is opposite each of the cap ports 34 so that a wire inserted into the cap will encounter the spring finger and move it upwardly as the wire enters the case. The free end of the spring finger will press on the conductor, preventing it from pulling out of the housing and pushing it into firm engagement with the busbar 40.

Turning now to FIGS. 6 and 7, details of the busbar 40 will be described. The busbar is a generally rectangular member made of tin-plated copper or other copper alloys, e.g., brass, phosphor bronze or the like. The busbar defines a thickness T (FIG. 9) between a top face 60 and a bottom face 62. It will be understood that the terms 'top' and 'bottom' are used herein for reference purposes only, as there is nothing inherent in the orientation of the busbar that would make one side or the other of the busbar a top or bottom portion. In the illustrated embodiment the top face 60 happens to be exposed to incoming wires while the bottom face 62 rests on the foot 44, but it could be otherwise. The busbar 40 further defines an entry edge 64, an exit edge 66, and at least two wire-crossing axes 68 extending from the entry edge to the exit edge. As used herein the entry edge will be considered the edge of the busbar first crossed by a conductor entering the housing and the exit edge will be considered the edge of the busbar last crossed by an entering conductor. The wire-crossing axis is the location where a conductor will lie, given the construction of the housing and the busbar's position therein.

The busbar 40 is attached to the foot 44 of the spring member 42 by means of rivets 70 extending into the apertures of the foot described above. The rivets 70 on the bottom face 62 may be formed by upsetting a portion of the busbar, leaving depressions 72 in the top face 60.

As shown in FIGS. 8-14, the busbar has a wire-receiving pocket 74 extending below the top face 60 on each of the wire-crossing axes 68 and a wire-engaging protrusion 76 extending above the top face 60 on each of the wire-crossing axes 68. The protrusion 76 may be formed by coining the busbar, which creates a depression 78 in the corresponding position on the bottom face 62 of the busbar. The wire-receiving pocket 72 has a depth D below the top face of at least about 50% of the thickness T of the busbar. The wire-receiving pocket has a length L1 of at least about 30% of the distance W between the entry edge and the exit edge of the busbar. The wire-engaging protrusion 76 has a height H above the top face of at least about 40% of the thickness T of the busbar. The wire-engaging protrusion has a length L2 of at least about 50% of the distance W between the entry edge and the exit edge of the baseplate. It has been found that these relationships provide suitable constraint on the conductor while pressed against the busbar. In particular, the depth D of the wire-receiving pocket must be sufficient to enclose enough of the sides of a stranded wire to prevent significant splaying of the wire. For exemplary purposes only and not by way of limitation, for a busbar to be used on wires sizes 12-18 AWG, T=0.030, W=0.160, D=0.017, L1=0.056, H=0.012 and L2=0.087, all dimensions in inches.

It can be seen that the pocket 74 and protrusion 76 form a serpentine path for the conductor to traverse over the top of the busbar. This configuration helps the spring finger 56 retain the conductor in the housing. As mentioned above the pocket 74 surrounds the conductor at least partially on three sides to prevent splaying of a stranded wire.

While the preferred form of the invention has been shown and described herein, it should be realized that there may be many modifications, substitutions and alterations thereto without departing from the scope of the following claims. The arrangement of the pocket and protrusion could be other than as shown. For example, the spring finger need not be disposed adjacent the entry edge of the busbar. That is, the busbar could be shifted to the left as seen in FIG. 3. Alternately, or in combination with such a shift of the busbar position, the wire-engaging protrusion could be on the entry side and the wire-receiving pocket could be on the exit side of the busbar. Or the wire-receiving pocket could be split into two sections on either side of an intervening protrusion. Or the wire-receiving pocket could extend all the way across the busbar from the entry edge to the exit edge with no protrusion. Also, while the connector is shown having three ports and a spring assembly for three wires, the number of wires which the connector can accommodate could be other than as shown. Finally, while the dimensions given for illustrative purposes will accommodate a particular range of wire sizes, other dimensions could be used to accommodate other ranges of wire sizes.

We claim:

1. A push-in wire connector, comprising:

a housing having a hollow interior and at least two openings providing access to the interior for the ends of wires inserted into the connector;

a busbar mounted in the interior of the housing, the busbar defining a thickness between a top face and a bottom face, the busbar also defining an entry edge, an exit edge, and at least two wire-crossing axes extending from the entry edge to the exit edge;

the busbar having a wire-receiving pocket extending below the top face on each of the wire-crossing axes and a wire-engaging protrusion extending above the top face on each of the wire-crossing axes.

2. The push-in connector of claim 1 wherein the wire-receiving pocket adjoins the entry edge.

3. The push-in connector of claim 2 wherein the wire-engaging protrusion adjoins the exit edge.

4. The push-in connector of claim 1 wherein the wire-engaging protrusion is coined in the busbar.

5. The push-in connector of claim 1 further comprising a spring member mounted in the housing.

6. The push-in connector of claim 5 wherein the spring member includes at least two spring fingers each having a free end, one spring finger being aligned with each crossing axis, and the busbar is disposed such that prior to insertion of a wire the free ends of the spring fingers lies at least partially in a wire-receiving pocket.

7. The push-in connector of claim 1 wherein the wire-receiving pocket has a depth below the top face of at least about 50% of the thickness of the busbar.

8. The push-in connector of claim 7 wherein the wire-receiving pocket has a length of at least about 30% of the distance between the entry edge and the exit edge of the busbar.

9. The push-in connector of claim 1 wherein the wire-engaging protrusion has a height above the top face of at least about 40% of the thickness of the busbar.

10. The push-in connector of claim 9 wherein the wire-engaging protrusion has a length of at least about 50% of the distance between the entry edge and the exit edge of the baseplate.

11. A push-in wire connector, comprising:

a housing having a hollow interior and at least two openings providing access to the interior for the ends of wires inserted into the connector;

a busbar mounted in the interior of the housing, the busbar defining a thickness between a top face and a bottom face, the busbar also defining an entry edge, an exit edge, and at least two wire-crossing axes extending from the entry edge to the exit edge;

the busbar having a wire-engaging protrusion extending above the top face on each of the wire-crossing axes, the wire-engaging protrusion having a height above the top face of at least about 40% of the thickness of the busbar and wherein the wire-engaging protrusion has a length of at least about 50% of the distance between the entry edge and the exit edge of the busbar.

12. A push-in wire connector, comprising:

a housing having a hollow interior and at least two openings providing access to the interior for the ends of wires inserted into the connector;

a busbar mounted in the interior of the housing, the busbar defining a thickness between a top face and a bottom face, the busbar also defining an entry edge, an exit edge, and at least two wire-crossing axes extending from the entry edge to the exit edge;

the busbar having a wire-engaging protrusion extending above the top face on each of the wire-crossing axes, the wire-engaging protrusion having a height above the top face of at least about 40% of the thickness of the busbar and wherein the wire-engaging protrusion adjoins the exit edge.

* * * * *